US010845075B2

(12) United States Patent
Taylor et al.

(10) Patent No.: US 10,845,075 B2
(45) **Date of Patent: *Nov. 24, 2020**

(54) THERMOSTAT WITH INTEGRATED SUBMETERING AND CONTROL

(71) Applicant: GridPoint, Inc., Reston, VA (US)

(72) Inventors: Sam Taylor, Wirtz, VA (US); Daniel K. Dyess, Roanoke, VA (US)

(73) Assignee: GridPoint, Inc., Reston, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/117,656

(22) Filed: Aug. 30, 2018

(65) Prior Publication Data

US 2019/0264935 A1 Aug. 29, 2019

Related U.S. Application Data

(63) Continuation of application No. 14/672,847, filed on Mar. 30, 2015, now Pat. No. 10,088,185.

(51) Int. Cl.

| | |
|---|---|
| ***F24F 11/30*** | (2018.01) |
| ***F24F 11/62*** | (2018.01) |
| ***F24F 11/70*** | (2018.01) |
| *F24F 110/00* | (2018.01) |
| *F24F 140/60* | (2018.01) |
| *F24F 11/32* | (2018.01) |
| *F24F 11/63* | (2018.01) |
| *F24F 11/64* | (2018.01) |
| *F24F 11/56* | (2018.01) |
| *F24F 11/46* | (2018.01) |

(52) U.S. Cl.

CPC ..... *F24F 11/30* (2018.01); *F24F 11/62* (2018.01); *F24F 11/70* (2018.01); *F24F 11/32* (2018.01); *F24F 11/46* (2018.01); *F24F 11/56* (2018.01); *F24F 11/63* (2018.01); *F24F 11/64* (2018.01); *F24F 2110/00* (2018.01); *F24F 2140/60* (2018.01)

(58) Field of Classification Search

CPC .... F24F 11/0012; F24F 11/006; F24F 11/001; F24F 11/0076

See application file for complete search history.

(56) References Cited

U.S. PATENT DOCUMENTS

| | | | | |
|---|---|---|---|---|
| 4,809,516 | A | 3/1989 | Jones | |
| 6,089,310 | A | 7/2000 | Toth et al. | |
| 10,088,185 | B2 * | 10/2018 | Taylor | F24F 11/30 |
| 2005/0105229 | A1 * | 5/2005 | Deng | H02J 9/062 361/90 |

(Continued)

OTHER PUBLICATIONS

Cheng Y. Yin et al., Design and Analysis of an Air-Filter Sensor for a Residential Heating and Cooling System, vol. 4, No. 2, Spring 2004, Dept. of Engineering Technology, Norfolk, VA.

(Continued)

*Primary Examiner* — Vincent H Tran

(74) *Attorney, Agent, or Firm* — Bookoff McAndrews, PLLC

(57) ABSTRACT

A thermostat with voltage and current sensing capability is coupled directly to an HVAC unit and provides low latency failure detection and control using an on-board CPU. The thermostat can be configured to detect failure modes using current and voltage sensing and to make autonomous decisions to control the HVAC in response to such measurements.

20 Claims, 6 Drawing Sheets

(56) References Cited

U.S. PATENT DOCUMENTS

| | | | | |
|---|---|---|---|---|
| 2006/0129339 | A1 | 6/2006 | Bruno | |
| 2008/0255782 | A1 | 10/2008 | Bilac et al. | |
| 2009/0018673 | A1* | 1/2009 | Dushane | G05B 19/042 700/9 |
| 2009/0090115 | A1* | 4/2009 | Boydstun | F24F 11/30 62/126 |
| 2011/0264409 | A1* | 10/2011 | Jayanth | F04B 35/04 702/182 |
| 2012/0123995 | A1 | 5/2012 | Boot | |
| 2013/0018513 | A1 | 1/2013 | Metselaar | |
| 2013/0066479 | A1 | 3/2013 | Shetty et al. | |
| 2014/0067134 | A1 | 3/2014 | Grabinger et al. | |
| 2014/0214214 | A1 | 7/2014 | Asmus et al. | |
| 2014/0262133 | A1 | 9/2014 | Brown et al. | |
| 2014/0266755 | A1 | 9/2014 | Arensmeier et al. | |
| 2014/0379298 | A1 | 12/2014 | Gilbert | |
| 2015/0073605 | A1* | 3/2015 | St. Mars | F24F 11/30 700/276 |
| 2015/0105930 | A1* | 4/2015 | Sparrowhawk | G01R 11/04 700/297 |
| 2015/0261230 | A1 | 9/2015 | Kates | |

OTHER PUBLICATIONS

Eliminate Voltage Unbalance, Motor Systems Tip Sheet #7, Sep. 2005, U.S. Department of Energy.

Gary Nelson, Measuring Total System Airflow in Residential HVAC Systems, Oct. 26, 2001, Energy Conservatory, Minneapolis, MN.

John Mix, HVAC Efficiency Definitions, May 2006, Carrier Corporation.

Measuring Enthalpy to Calculate Efficiency, Application Note 96-02000-08, Power Knot LLC, Milpitas, CA.

Motor Protection Voltage Unbalance and Single-Phasing, 2002, SPD Selecting Protective Devices Based on the 2002 National Electrical Code, Cooper Bussman.

Stephen Heston, Explaining the Increase in Fan Amperage with Installation of a V-Belt Tensioner, 2013, Fenner Drives, Manheim, PA.

* cited by examiner

THERMOSTAT WITH INTEGRATED SUBMETERING AND CONTROL

CROSS-REFERENCE TO RELATED APPLICATION(S)

This patent application is a continuation of U.S. patent application Ser. No. 14/672,847, filed on Mar. 30, 2015, the entirety of which is incorporated herein by reference.

BACKGROUND OF THE INVENTION

1. Field of the Invention

The invention relates generally to the field of thermostats, and in particular to systems and methods for monitoring heating, ventilation, and air conditioning (HVAC) units using a thermostat.

2. Description of the Related Art

An energy management system (EMS) typically monitors and controls multiple endpoints such as HVAC units, lighting panels, natural gas consumption, refrigeration, temperature monitors, and other power consuming or monitoring devices located throughout one or more zones of a building or buildings. A monitoring device is mounted to the wall of such a building in or near an electrical room and is wired to common voltages at the electrical distribution panel (or breaker box) so as to receive voltage readings. The monitoring device is also wired to current transformers (CTs) coupled to the electrical lines at the electrical distribution panel so as to receive current readings from the electrical lines of one or more circuits, for example, an HVAC unit and/or lighting group. The monitor typically forwards this voltage/current data to a site controller, also mounted in the building, which in turn transmits power or consumption data to an off-site server for storage and processing. Each building also contains one or more thermostats mounted to the wall of the building, each associated with an HVAC unit. Each thermostat controls its corresponding HVAC unit based on the temperature setting and schedule. The monitors, thermostats, and site controller are wired together at each site to form the core of the local EMS hardware system. The monitored data is transmitted from the off-site server to a central control and monitoring EMS that is remote from the building or buildings being monitored. The monitored data is typically presented to a user/operator overseeing the operation of one or more of the buildings via a computer monitor coupled to the EMS.

As can be appreciated, while an EMS with such a configuration offers a highly flexible solution for large fleets of buildings under a common control, it also contains more components than necessary for some smaller facilities having few numbers of monitored endpoints. Further, the large number of components and remote communications of a typical cloud-based EMS can introduce latency into the system thereby preventing quick detection and response to HVAC problems reflected in the monitored data.

SUMMARY OF THE INVENTION

Various embodiments of the invention solve the above-mentioned problems by providing a thermostat with integrated metering and the ability to calculate HVAC operation costs and determine failure conditions at the site. In an embodiment, the invention provides a thermostat collocated with the HVAC unit and having current and voltage monitoring capabilities, as well as the ability to analyze HVAC conditions and provide diagnostics. In an embodiment, the invention provides a low cost integrated processing unit that is collocated with the HVAC system and which has the ability to quickly perform local current and voltage sensing, processing, reporting, and response with a limited number of components.

In an embodiment, a thermostat is provided for controlling HVAC equipment mounted on a roof of a building. Alternatively, the HVAC unit could be mounted adjacent to the building, or internal to the building. The thermostat is mounted within a cabinet enclosing the HVAC equipment. The thermostat includes one or more current sensing inputs electrically connected to current transformers magnetically coupled to one or more phases of an electrical supply powering the HVAC equipment within the cabinet. The thermostat further includes one or more voltage sensing inputs configured to receive voltages indicative of the one or more phases of the electrical supply powering the HVAC equipment within the cabinet. One or more control signal outputs are configured to generate HVAC control signals that are coupled to control inputs of a controller board of the HVAC equipment. One or more temperature sensing inputs are configured to sense the temperature of a zone within the building controlled by the HVAC equipment. A central processor of the thermostat is configured to calculate real time energy use based on the voltage and current measurements. The processor is further configured to control the HVAC unit to keep the zone within the building within a temperature range based on set points stored within the thermostat and from data from the one or more temperature sensing inputs. The thermostat includes a memory for storing energy use calculations and a communications port for sending energy usage calculations to an external device.

BRIEF DESCRIPTION OF THE DRAWINGS

These and other features, aspects, and advantages of the present invention will become better understood with reference to the following description and appended claims, and accompanying drawings where:

Figure 1:
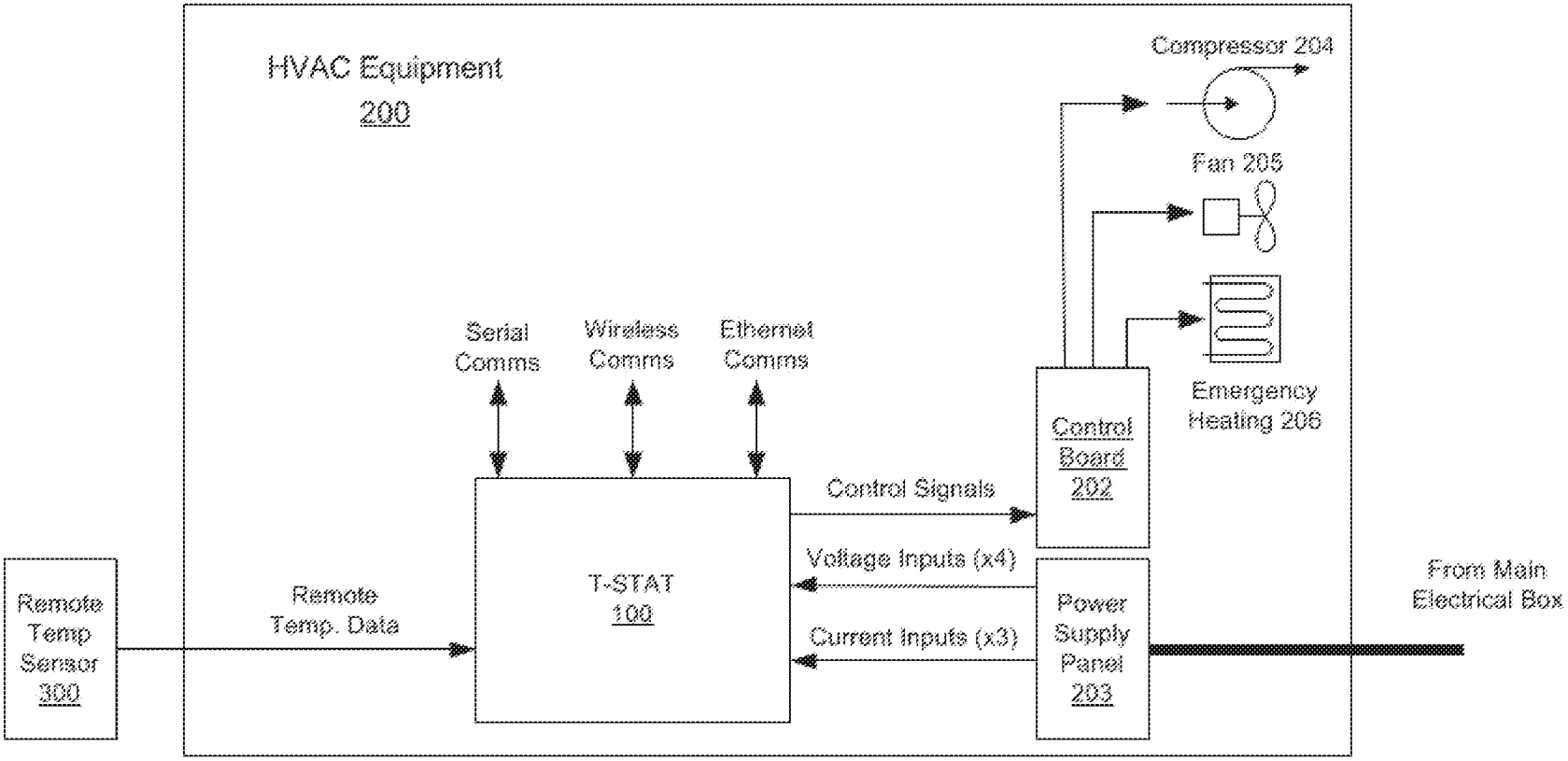
FIG. 1 is a block diagram illustrating a thermostat coupled to HVAC equipment.

Some figures illustrate diagrams of the functional blocks of various embodiments. The functional blocks illustrated herein are not necessarily indicative of the division between hardware circuitry. Thus, for example, one or more of the functional blocks (e.g., processors or memories) may be implemented in a single piece of hardware (e.g., a signal processor or a block or random access memory, hard disk or the like). Similarly, the programs may be standalone programs, may be incorporated as subroutines in an operating system, may be functions in an installed software package, and may reside in collocated or remotely located servers. It should be understood that the various embodiments are not limited to the arrangements and instrumentalities shown in the drawings.

DETAILED DESCRIPTION OF THE INVENTION

The present invention may be understood more readily by reference to the following detailed description of preferred embodiments of the invention as well as to the examples included therein. Embodiments of the invention provide systems, methods, and software, for thermostat monitoring of an HVAC unit.

FIG. 1 is a block diagram illustrating an embodiment of a thermostat (TSTAT 100) coupled to HVAC equipment 200. HVAC equipment can be, for example, a roof top unit mounted on the roof of a facility at a site. TSTAT 100 is preferably mounted inside the cabinet of HVAC equipment 200. TSTAT 100 receives temperature readings from the remote temperature sensor 300 located external to the HVAC equipment 200 and within the building environment that is controlled by HVAC equipment 200. TSTAT 100 sends control signals to control board 202, which is also mounted on the interior of HVAC equipment 200. The control signals are interpreted by the control board 202 so as to control hardware in the HVAC equipment 200, such as compressor 204, fan 205, and emergency hearing 206.

In an embodiment, three phase voltage signals and neutral are directly coupled from the power supply panel 203, mounted on the inside of the HVAC equipment 200, to isolated inputs on TSTAT 100. Current transformers (CTs) are placed on one or more of the three phase wires to detect current and are wired to current inputs on TSTAT 100. TSTAT 100 processes the voltage and current data and communicates that data to a site controller over one or more communication mediums, such as serial, wireless, or Ethernet connections.

Figure 2:
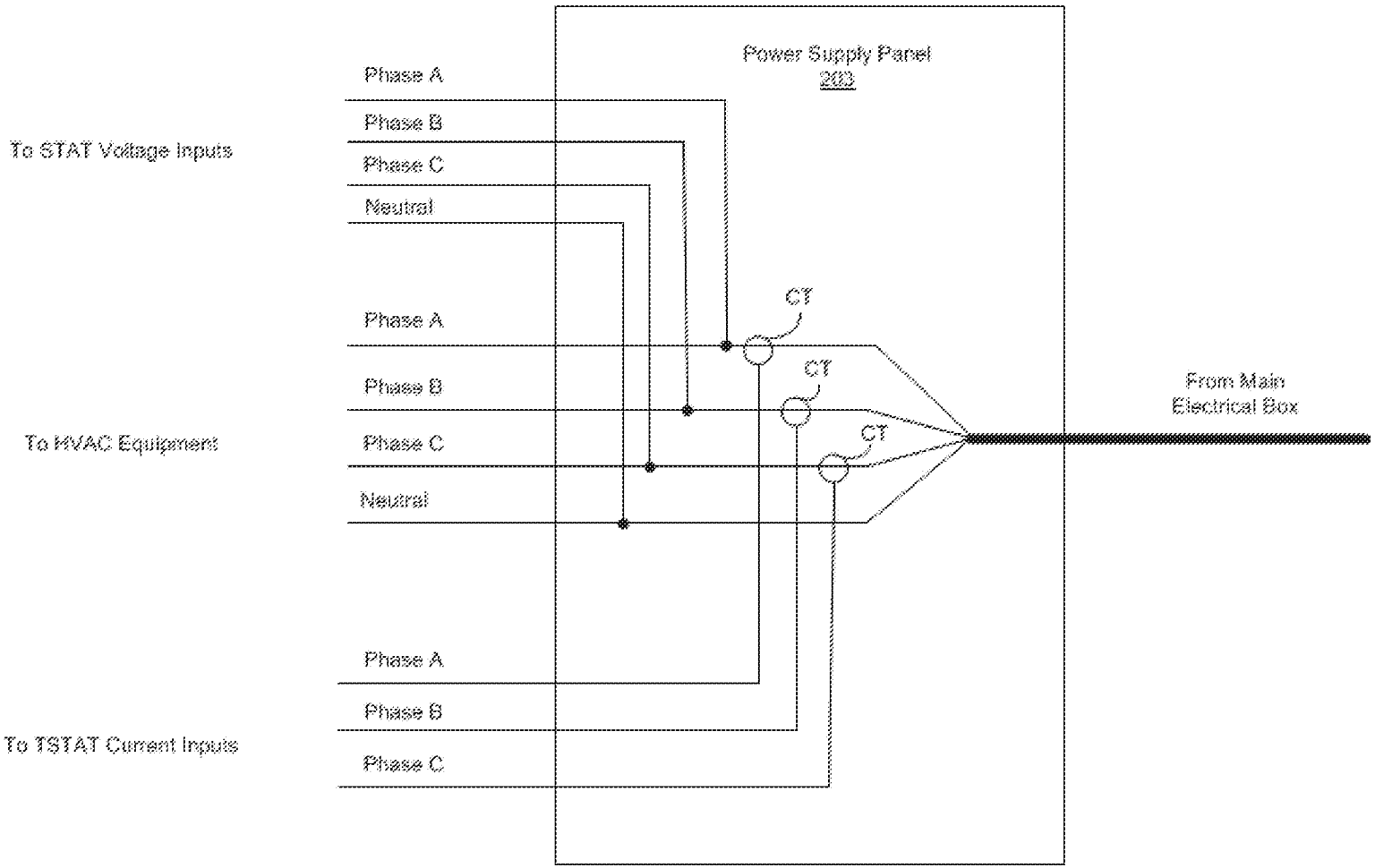
FIG. 2 is a schematic diagram of a power supply panel with direct voltage measurement taps.

FIG. 2 is a schematic diagram illustrating an embodiment of a power supply panel 203 with direct voltage measurement taps. As shown, voltage phases A-C and neutral are directly coupled to the HVAC equipment and also to the voltage inputs of TSTAT 100. CTs are attached to each of the 3 phases A-C and coupled to the current inputs of TSTAT 100.

Figure 3:
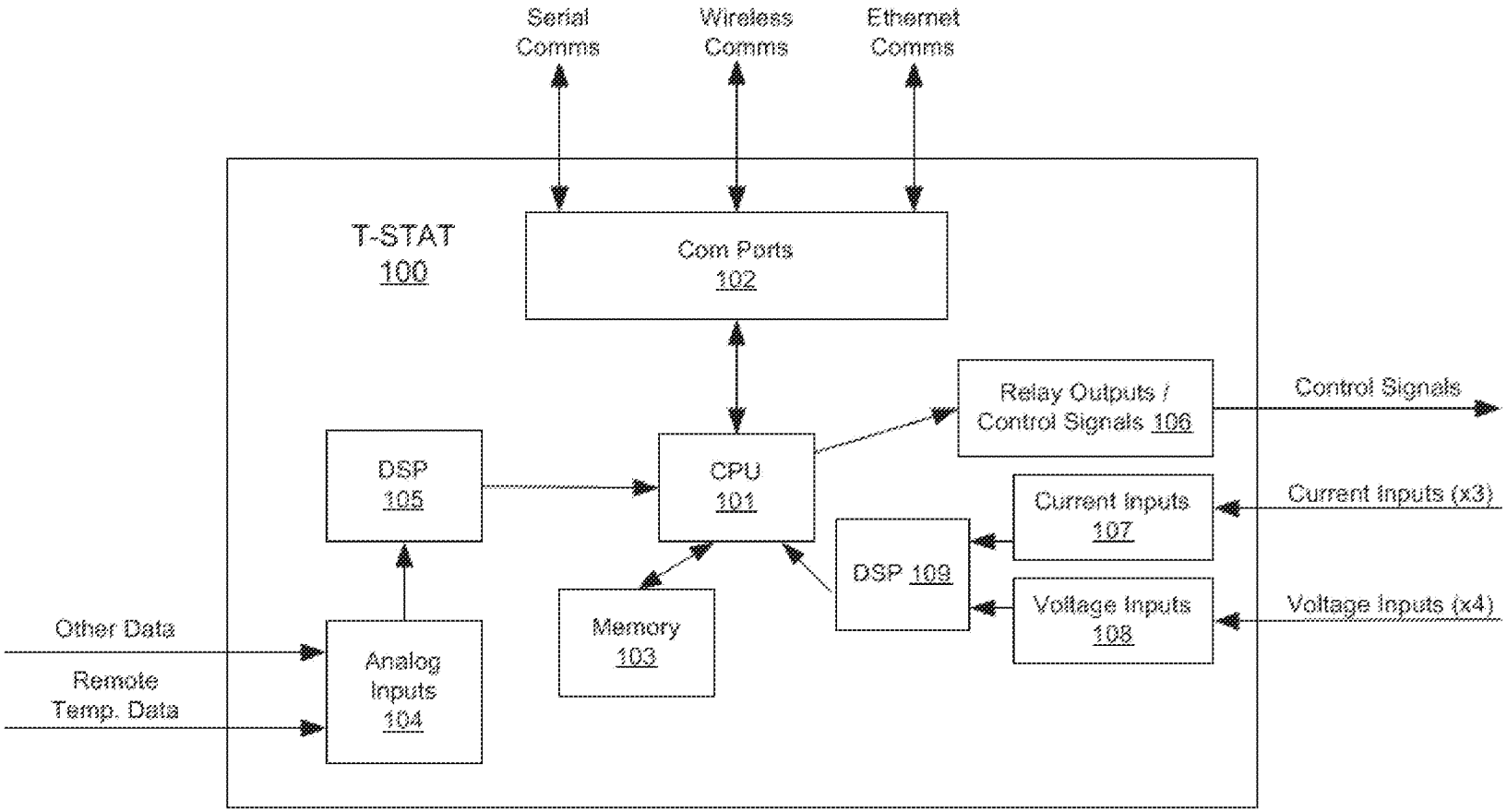
FIG. 3 is a block diagram illustrating the internal functions of a thermostat.

FIG. 3 is a block diagram illustrating internal functions of TSTAT 100 in an embodiment thereof. TSTAT 100 includes a CPU 101, communications ports 102, memory 103, analog inputs 104, relay outputs and control signal 106, analog current inputs 107, analog voltage inputs 108, and digital signal processing circuitry (DSP) 105 and 109. Analog inputs 104 receive temperature data from remote temperature sensor 103, which is then processed by DSP 105. Analog current inputs 107 receive signals from one or more CTs coupled to the power supply lines to HVAC equipment 200. Analog voltage inputs 108 receive signals from one or more of the power supply lines to HVAC equipment 200. The received analog current and voltage signals are processed by DSP 109 to make determinations about the state of the HVAC equipment 200. DSP 109 includes A/D conversion and other circuitry to produce time series digital power data at selected intervals. Processed data from DSP 109 can be stored in memory 103 and used by CPU 101 to control HVAC 200 via relay and control signals 106 as well as to report measurement, status, or alarm conditions back to a site controller and then to a remote server (not shown) so that users can be notified. The close proximity of TSTAT 100 to HVAC equipment 200 reduces the latency between the time of detection of an alarm condition and a controlled response to that alarm condition by allowing TSTAT 100 to make autonomous decisions and issue appropriate controls to HVAC 200 within predefined and configurable constraints.

Current and Voltage Measurement

Operation cost of an HVAC unit can be calculated by measuring the real time power usage and then applying the utility rate formula to the power usage. Real time power is derived from current and voltage at the HVAC inputs. Currents are measured by analog current inputs 107 receiving signals from CTs coupled to each of the three-phase circuits driving the HVAC 200. Voltage is measured by the voltage inputs 108, which are electrically coupled to voltage contacts within the HVAC 200 unit itself. Preferably, the CTs and voltage taps are collocated near the TSTAT 100. Such colocation of the CTs, voltage taps, and TSTAT 100 obviates the need for cable runs to a breaker box within the building and can result in noise reduction and improve current and voltage measurement accuracy.

The voltages and currents are simultaneously sampled over a full cycle by current inputs 107 and voltage inputs 108. DSP 105 calculates real and reactive power usage using a known formula. A point-to-point multiplication of the voltage and current will yield Real power usage in kilowatts (KW). A multiplication of Voltage with a 90 degree phase shifted current waveform will yield Reactive power usage (KVAR). The phase shift is typically accomplished using a simple time delay based on the frequency of the service, 60 Hz in most of the world, and 50 Hz in the European Union. With these two values, the power factor (KW/(KVAR+KW)) can be obtained and the total KVA calculated. The KW, KVAR and KVA can be summed over a given time interval to provide KWH, KVARH and KVAH. A method of sampling and calculation is disclosed in U.S. Pat. No. 7,460,930, which is incorporated herein by reference. Results can be stored in memory 103 and periodically reported back to a site controller and then on to the cloud server for analysis and review. For relatively simple systems using a single HVAC unit, the site controller can be left out and results be sent directly from TSTAT 100 to the server via a communication ports 102.

In a typical metering installation, the voltage is taken from a panel that has a free breaker within the electrical room of a facility. With this approach, it is difficult to detect HVAC wiring and installation problems between the electrical room and the HVAC cabinet. In contrast, placing the metering within the HVAC cabinet itself has several advantages. First, it is more accurate. Relatively short runs between power lines and the voltage and current sensors reduce the amount of noise being measured. Second, in systems having multiple HVAC units or where a single power line is connected to multiple pieces of equipment, there is little chance of confusion about which HVAC unit is being measured. Third, there is less chance of injury to installers because they will not be required to perform work near main breaker box of a facility. Finally, avoiding installation work near main electrical panels can reduce installation time and expense.

Measuring power by directly contacting high voltage lines can potentially damage low power control circuitry in TSTAT 100. Therefore, it may be advantageous to measure the voltage source powering the TSTAT card instead of direct line voltage measurements being taken from the illustrating an embodiment of a power supply panel with voltage measurements being taken from the secondary windings of a transformer. Such transformers are typically present within the cabinets of HVAC equipment in order to supply power to the HVAC control board, such as control board 202. As shown, phases A and B are coupled to the primary side of transformer 207. Transformer 207 typically has a winding ratio of 208:24 for 1 volt systems and 480:24 for 277 volt systems. The secondary side of transformer 207 is coupled to two (2) voltage inputs of TSTAT 100. The 24 VAC lines that supplying power to the TSTAT card and control board 202 are scaled in TSTAT 100 to reflect the actual voltage on the primal side of transformer 207. Any variation on the primary side of transformer 207 will be proportionally reflected and measured on the secondary side. The result is in approximation of the total metered KW, KVAR, KVA based on one phase assuming that the load balanced. The resultant values can be multiplied by a scalar value of 3 to arrive at values for a 3 phase systems. Additional transformers can be added to allow measurement of the other two phases. This approach allows calculation of power and power factor the equipment without coupling high voltage power lines directly to TSTAT 100. Further, because a transformer for the control board is typically present within the HVAC cabinet obtaining voltage measurement in this manner is highly economical.

Imbalance Detection

During normal operation, the current and power flow through the three phases of the HVAC power supply lines should be well balanced. If the voltage phases become imbalanced within certain threshold limits, this could lead to a problem with the compressor, motor, or other 3 phase load within the unit. Voltage phase imbalance measurements can be performed by metering the voltages at each of the three phases. A high phase voltage imbalance can cause current imbalance that far exceeds the voltage imbalance and can degrade the performance and shorten the life of a three-phase motor.

Voltage phase imbalance is typically quantified in terms of Percent Voltage Imbalance. Percent voltage imbalance is defined as 100 times the absolute value of the maximum deviation of the line voltage from the average voltage on a three-phase system, divided by the average voltage.

% Voltage Imbalance=(100×(AV−VD)/AV, where

AV (Average Voltage)=(V1+V2+V3)/3

V1, V2, V3=Line Voltage Readings

VD=Line voltage reading that deviates the farthest from the average voltage.

It is recommended that voltage imbalances at the motor terminals do not exceed 1%. Voltage imbalance can cause extremely high current imbalance, in many cases up 6 to 10 times as large as the voltage imbalance. Further, high current imbalance results in increase Neutral currents on 3 phase systems, which can be dangerous. Voltage phase imbalance is normally calculated in real time and then averaged over the metering interval. The metering interval could be 1, 5, 15, or 30 minute(s) depending on the customer requirements and/or the utility billing practices. For extreme imbalance, for example, loss of an entire phase, an alarm would be triggered and raised to the attention of the user. Preferably, in this case the HVAC would immediately be shut down based on a decision the TSTAT level. Other alarm parameters and responses could be set up as the user dictates, based on the severity of the imbalance. Below is an exemplary table showing alarm threshold triggers and responses.

TABLE 1

| Percentage Voltage Imbalance | Alarm | Response |
|---|---|---|
| 0-0.5% | No Alarm | None |
| 0.5-4% | Send Standard Aland | Request Maintenance |
| >4% | Send Sever Alarm | Shutdown HVAC Equipment |

Figure 4:
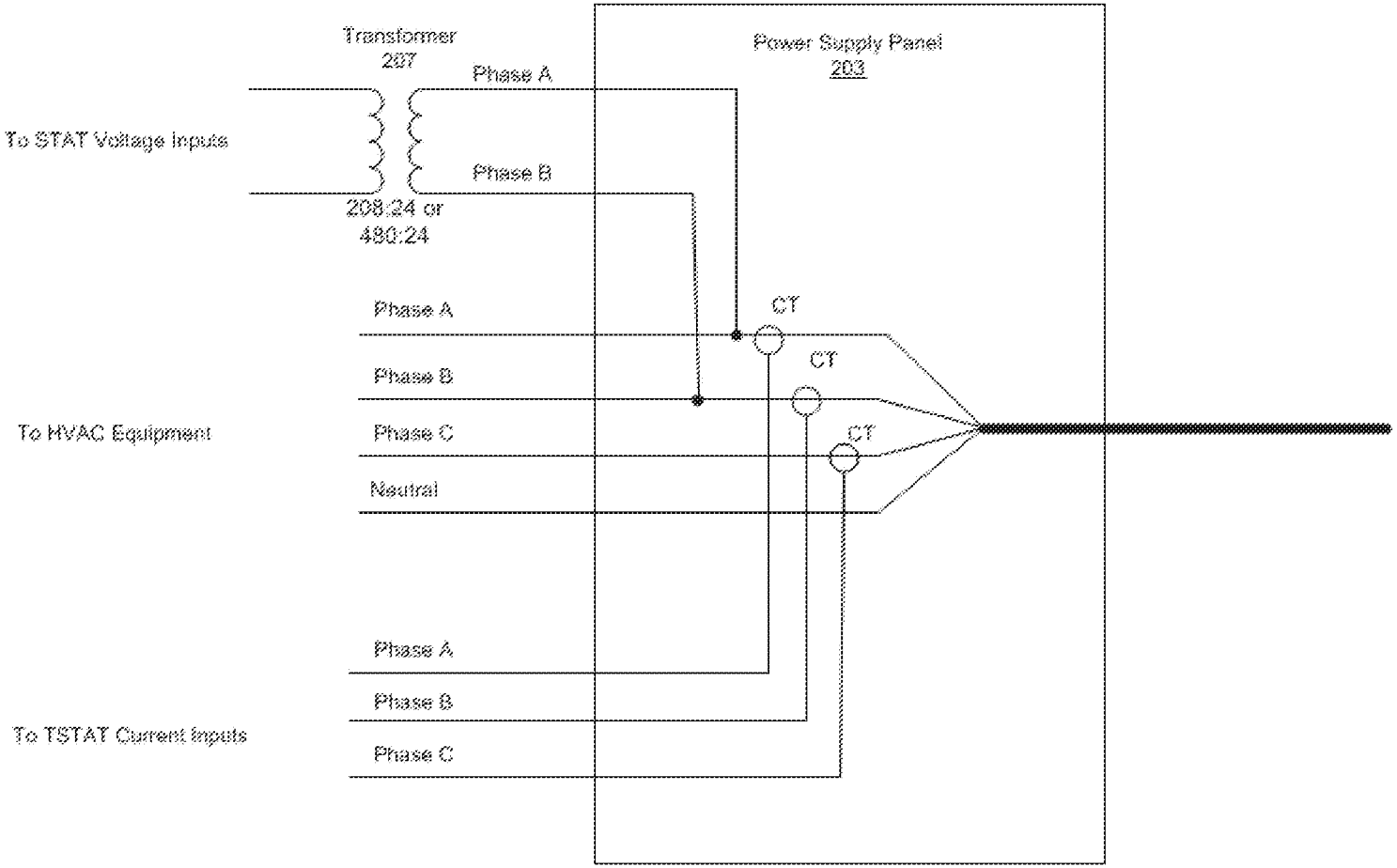
FIG. 4 is a schematic diagram of the power supply panel with voltage measurements being taken front the secondary windings of a transformer.

In many cases, it is not practical to directly sample all three voltage phases. However, metered currents can be used to detect voltage phase imbalances. As shown in FIG. 4, current can be measured at the HVAC power supply panel using CTs. The measured currents can be used to calculate the percentage current imbalance in much the same way as percentage voltage imbalance.

Percent current imbalance is defined as 100 times the absolute value of the maximum deviation of the line current front the average current on a three-phase system, divided by the average current.

% Current Imbalance=(100×(AC−CD))/AC, where

AC (Average Current)=(C1+C2+C3)/3

C1, C2, C3=Line Current Readings

CD=Line Current reading that deviates the farthest from the average Current.

Current imbalance is an indication that there could be a problem with the equipment and typically coincides with a voltage imbalance. If a current imbalance exists without a corresponding voltage imbalance of an expected magnitude, then the current imbalance is likely caused by a fault condition within the equipment. For example, if a motor has one winding that is going bad, it will draw more current (as in the case of a winding short circuit) or less current (in the case of an open circuit) than the other windings. A potential fault diagnosis based on the type of imbalance can also accompany the imbalance alert when raised.

Detection of Fan Motor Belt Malfunction

Detection of loose, overtightened and broken belts can also be detected by metering and measuring the fan motor current. Fan motor current can be measured by placing a CT on the line to the fan, thus isolating fan motor current draw from the heating element and compressor in the HVAC system. Fan current can also be measured by sampling one or more of the phases driving the equipment while the heating elements and compressors are turned off. This can be accomplished opportunistically by waiting for these other current drawing devices to cease operation before sampling the current.

Alternatively, the compressors and heating elements can be systematically shutdown on a regular basis in order to take periodic fan current measurements. In order to obtain a useful baseline, initial fan current measurements should be taken upon HVAC system installation, or upon scheduled fan belt maintenance or replacement.

For fielded HVAC systems that are being retrofitted with TSTAT 100, a baseline fan and compressor current could be obtained automatically from a database of operating parameters for that particular HVAC unit, thereby providing estimated expected performance curves until the a baseline can be established at the time of the next HVAC maintenance.

Figure 5:
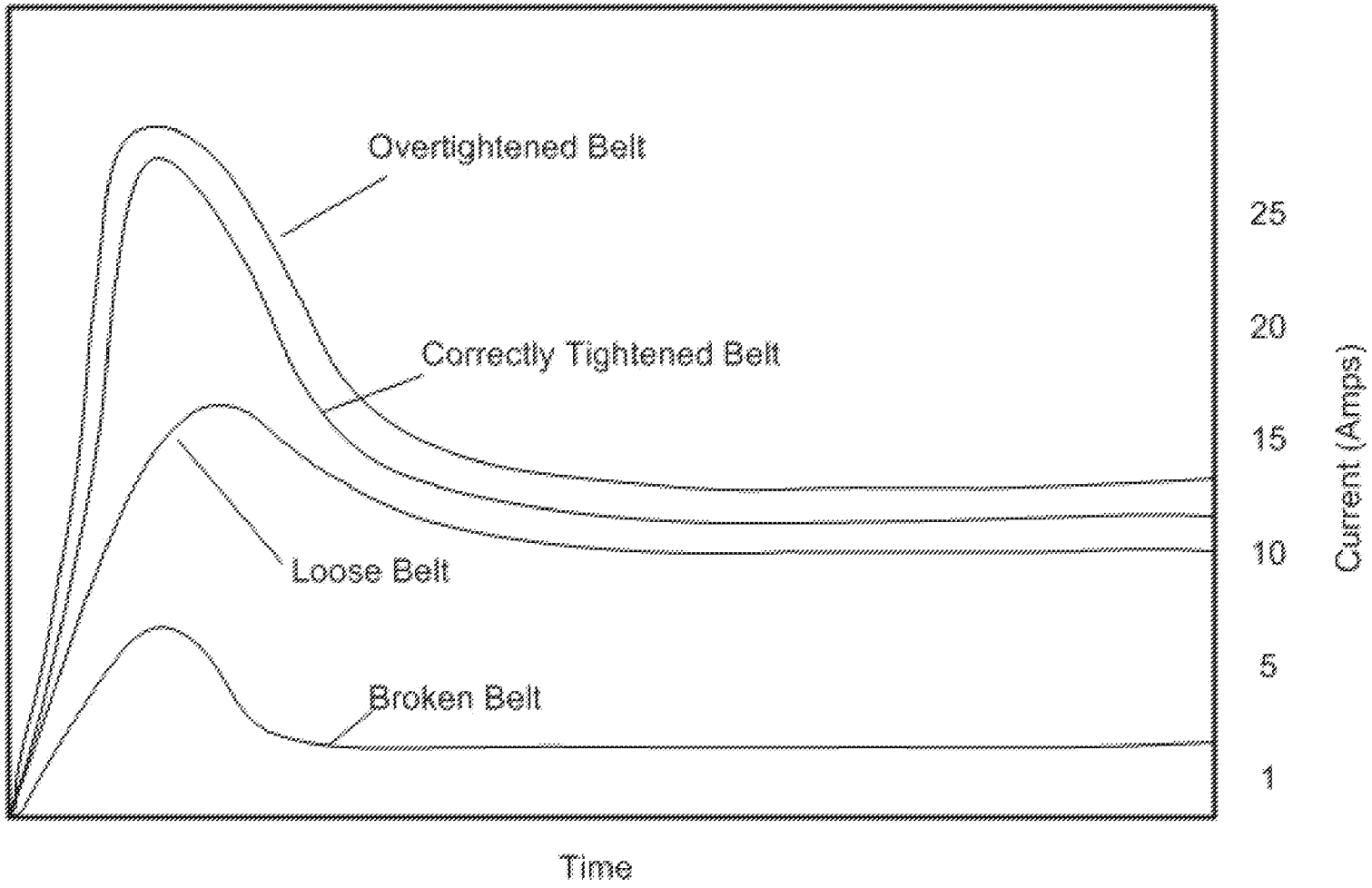
FIG. 5 is a graph showing typical startup and run time current readings of a fan motor.
Figure 6:
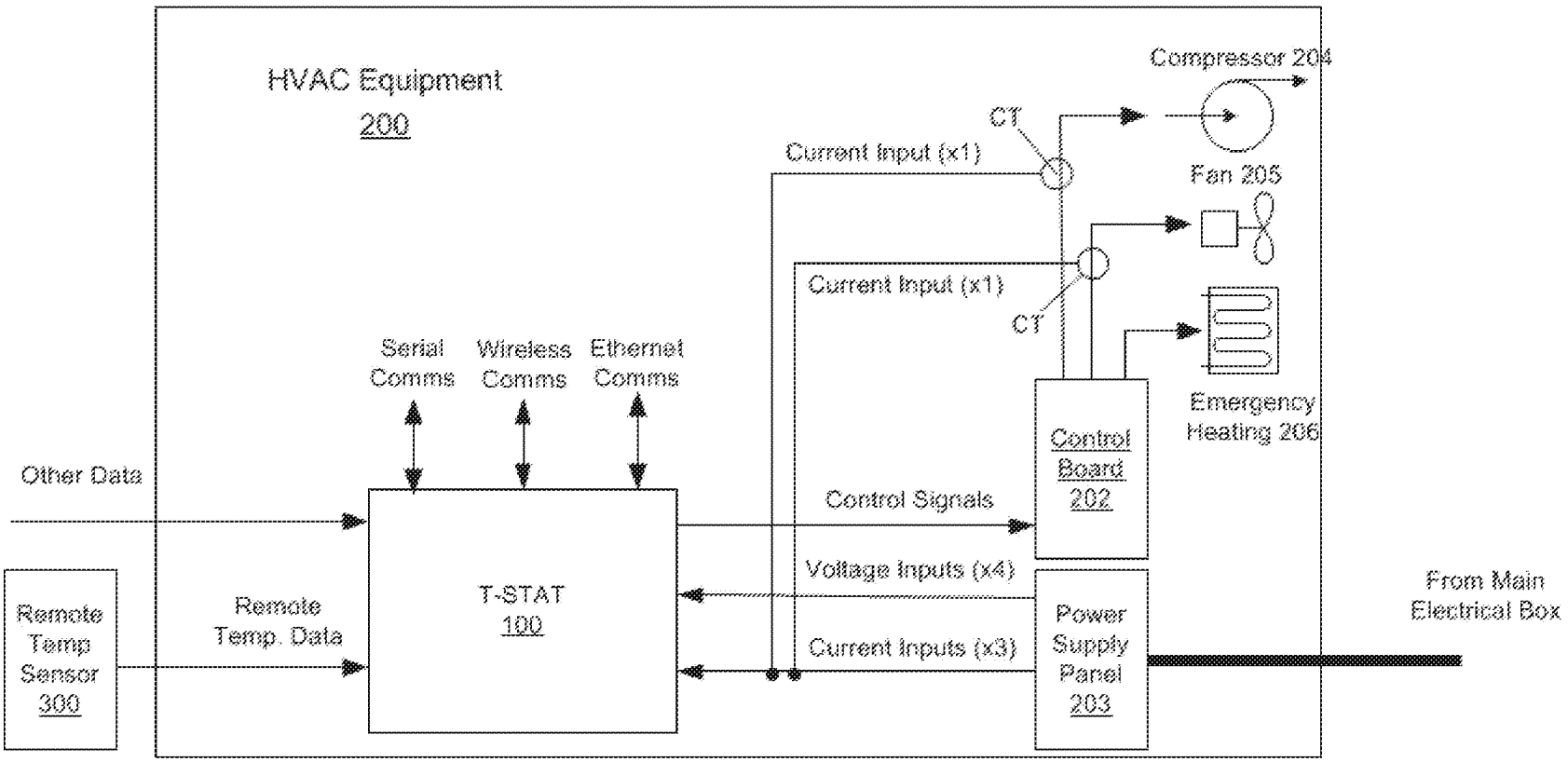
FIG. 6 is a block diagram illustrating a thermostat coupled to HVAC equipment along with current sensing of the compressor and fan.

TSTAT 100 can associate the measurement of fan motor current with both startup and runtime periods. As illustrated in FIG. 5, deviations in fan current can be indicative of different fan belt conditions:

A loose belt would manifest as a low startup current and lower runtime current.

An overtightened belt would manifest as a high startup current and higher runtime current.

A broken belt would manifest as a lower startup and runtime current (lower than the loose belt).

After taking fan current measurements, TSTAT 100 can compare the measurement to typical fan currents and provide maintenance alerts, and in some cases take immediate action to avoid damage to the fan motor or HVAC system. The actual current ranges will depend on the equipment. Alarms should therefore be based on a relationship of the actual current measurements to normal operating conditions for the metered fan motor under test. A normal baseline current range for both startup and run state of the fan motor can be obtained during initial installation of the TSTAT (if factory installed) or after maintenance on the equipment (for field installation). Matching the fault condition observed during maintenance to the startup and run time currents at the time of maintenance can allow particular fault profiles to be generated and alarmed on. Below is an example of an alarm table based on actual measured fan start up current.

TABLE 2

| Fan Current (Amps) | Alarm | Response |
|---|---|---|
| Less than <0.2 × Baseline | Alarm | Shutdown HVAC Equipment and Request maintenance |
| Between 0.2 and 0.5 × Baseline | Send Alarm (under-tightened) | Request Maintenance |
| Above 1.2 × Baseline | Send Alarm (over-tightened) | Request Maintenance |

Current draw deviations from the baseline due to improperly tightened fan belts can be distinguished from current draw deviations due to other factors, such as clogged filters, by comparing the ratios of maximum startup current to steady state run time current and/or the time it takes to reach steady state run time current draw. A smaller ratio or longer time period to reach steady state run current can indicate fan belt slippage in cases where it is under tightened. Startup-to-steady state current profile curves can be comparted to stored baseline profiles for various degrees of fan belt tightness in order to filter out the effects of current draw deviations due to other components and conditions in the HVAC unit.

Various other types of real-time failure detection can also be achieved by directly metering the equipment. For example, if the TSTAT 100 signals the HVAC equipment 200 said to turn on Stage 2 heat/cool, but no load increase was detected, then an alarm could be triggered. If TSTAT 100 signals the HVAC equipment 200 to off, and no load decrease is measured, then another type of alarm could be triggered.

Detection of Dirty/Clogged Filters

For some types of fan motors, a blocked filter not only reduces air flow through the HVAC system, but can cause excessive current draw and higher temperatures thereby reducing the life of the motor. For other types of fan motors, blocked filters cause less current to be drawn, but still requires the fan motor to run for longer periods of time and cause some HVAC components to operate at temperatures outside of their recommended temperature ranges. Air filters are typically changed on a regular schedule to minimize costs and improve equipment longevity. However, not all environments contain the same amount and type of particulates and not all HVAC systems draw the same amount of air volume though their filters on a daily basis. For an HVAC system in a relatively clean environment with a minimal amount of air exchange, frequent replacement of the air filter unnecessarily increases the cost of both new filters and the labor to perform the maintenance. For an HVAC system in a relatively dirty environment that is operating at a high percentage of the time, the filter replacement schedule may be too infrequent. Therefore, detecting clogged or dirty air filters can provide for a more precise timing for air filter replacement thus reducing maintenance and runtime costs.

Metered currents can be used to detect dirty/clogged filters in the HVAC equipment. As discussed above, a dedicated CT is attached to the fan line to monitor fan current. Alternatively, the fan current can be calculated by subtracting off the current draws calculated for other components in the system. To determine whether an air filter is clogged or dirty by measuring current draw, a baseline fan motor current profile must be generated. To do this, a calibration must be initiated at the time of each filter replacement to ascertain the fan current draw when using a new clean filter. The next time the filter fan runs after a new filter in installed, fan motor current is measured and stored in memory 103 for later use. A predetermined filter profile that denotes the various percent current level increases for corresponding degrees of filter blockage is also downloaded into memory 103. An exemplary profile is reproduced below with suggested current thresholds for providing alarms with a fan motor whose current draw decreases as air filter blockage increases. Similar tables can be used for motors whose current increases as blockages increases.

TABLE 4

| Fan Current as % of Baseline Current | % Filter Blocked | Alarm |
|---|---|---|
| 100% | 0% | None |
| 93% | 25% | Provide Notice |
| 88% | 50% | Request Maintenance |
| 84% | 75% | Shutdown Equipment |

Fan filter current is then periodically measured and the actual percent current level increase over the baseline current is measured in any of the same ways as described above. Using the percentage current change vs. percentage blocked criteria allows the fan current of any HVAC system to be normalized and applied against the same filter profile. A different or multiple filter profile can be downloaded and used for different types of air filters.

In an embodiment when TSTAT 100 determines that an air filter is sufficiently dirty or clogged to require replacement, a request for maintenance is issued and the air filter is replaced. The TSTAT 100 can be configured such that, if the technician replacing the filter determines that the filter was not sufficiently dirty to warrant replacement, they can indicate such at a terminal accessing the EMS or directly on an LCD screen of a site controller. For simplicity, the TSTAT 100 can be configured to prompt the technician to press a first button indicting that the filter was more clogged than expected or a second button indicating that the filter was less clogged than expected. Over time, TSTAT 100 can learn and update the percentage current profile reflecting the effects of dirty and clogged filters over time. Data reflecting these filter profiles can be reported back to the server to update and refine a larger set of filter profiles that can be used as the default profile for other HVAC systems.

More sophisticated performance models can be generated based on the types of filters used so that the user can select the most economical filter available. Moreover, thresholds for failure detection could be adjusted up or down based on the life time remaining on a filter in order to prevent false positive or false negative alarm triggers.

EER/SEER Rating Calculation

HVAC equipment is typically sold with EER/SEER ratings so the end user can determine which HVAC unit is the best choice from a financial perspective. However, it is difficult to know if the HVAC unit is meeting its ratings, particularly after it has been in operation for some time. As described below, real-time EER/SEER rating estimation can be achieved for the HVAC equipment being controlled by measuring real-time energy consumption and cooling output. These estimations can be trended and alarmed if degradation occurs. Based on real time power usage information and certain equipment specific information (BTU/h rating) actual EER and SEER values of the equipment can be calculated during real world conditions. By monitoring EER/SEER, it is possible to determine which HVAC equipment manufacturer's equipment is the most efficient. It may also be possible to determine if there is a problem with the equipment based on its estimated EER/SEER rating. Degradation in EER/SEER could indicate that maintenance is needed, e.g., coil cleaning, filter change, coolant/refrigerant recharge or the like.

The Energy Efficiency Ratio (EER) of an HVAC unit is the measure of how many watts of power the HVAC system uses to deliver each Btu/hour of cooling power. EER of an HVAC system is calculated under a specific outside air temperature (95 degrees), a specific inside air temperature (80 degrees), and a 50% relative humidity. Power can be determined using the current and voltage monitoring TSTAT described above. There are several problems associated with calculating EER in a fielded system and comparing it to its rated EER. First, while power consumption of the HVAC unit can be accurately measured using the above-described TSTAT 200, accurately measuring the Btu of the cooling power is more difficult. One way of performing this Btu/h measurement is to measure the difference in enthalpy at the HVAC supply and return ducts along with the air volume passing through the HVAC unit. Techniques for measuring enthalpy and air volume are known, but require multiple relative multiple humidity sensors, anemometers, and knowledge of the supply duct dimensions. With this equipment in place, the instantaneous Btu output can be calculated and summed over a time period during which power consumption is measured. The TSAT stores information about when the HVAC is running and when it is not, and performs the calculation Capacity (Btu/h)/Power over a period during which the HVAC system is running.

Other approximations of Btu/h may be performed without the use of enthalpy detectors at the supply and return duct and anemometers. For example, the airflow rating of the HVAC unit can be substituted for the CFM measurement and enthalpy can be estimated based on a humidity sensor placed in the indoor environment. Humidity sensors are often standard equipment in buildings and in many cases the TSTAT 100 will already have that information from an existing sensor input. TSTAT 100 can also have the fan speed information for variable speed blowers and can therefore determine the CFM for a particular speed and duct supply cross section.

A second problem associated with calculating EER is that the standard test conditions in a fielded system are rarely the same as the test conditions under which an HVAC system is tested by the manufacturer. In other words, the outside temperature is rarely exactly 95 degrees, the inside temperature is not always set to 80 degrees, and the relative humidity is rarely exactly 50%. One way to reduce the effects of the variations in real world conditions is to detect times when these conditions exist and only perform EER calculations during those conditions. Alternatively, appropriate normalizing curves can be applied to adjust the EER calculation to match what it would have been under correct test conditions. Making highly accurate measured EER to factory EER comparisons using such approximations will be difficult. However, it will be possible to detect EER ratings falling short of the predetermined threshold below the factory EER. Further, EER calculations for a wide variety of temperature and humidity conditions, as well as fan speeds, can be taken upon installation and/or maintenance and baseline tables can be built from that data. Over time, ERR measurements can be compared to similar conditions and deviations from the baseline can be more precisely detected and alarmed.

Further, the estimated EERs of dissimilar models of HVAC units operating at the same physical location can be compared to determine which unit is more efficient. The physical colocation of the different models of HVAC units will have the effect of nullifying the effects of disparate temperature and humidity conditions.

The Seasonal Energy Efficiency Ratio (SEER) is similar to EER, except that it measures the efficiency of an HVAC Unit over a typical season of use. The SEER is calculated by dividing the cooling output for a typical cooling season by the total electric energy input during the same time frame. To determine SEER ratings, measurements of Btu and energy consumed by the HVAC unit is performed under conditions that simulate the temperature and humidity during a typical cooling season. A higher SEER rating means greater seasonal energy efficiency.

While SEER ratings are intended to represent the seasonal efficiency over a wide span of temperatures occurring during a typical cooling season, the testing is done at the average of those outdoor temperatures (82 degrees), an inside temperature of 80 degrees, and at an indoor relative humidity of 50%. The SEER estimation can be performed in much the same as the EER calculations were performed as described above, expect a different set of temperature conditions are used. Alternatively, TSTAT 100 can keep a set of instantaneous SEER calculation at various times of each day as well as a seasonal windowed average over the cooling season. Other shorter sliding window lengths could be applied to give the efficiency rating over days, weeks, months, or any other selected time period. Efficiency rating calculations for shorter time windows can be compared to historical efficiency windows of calculated during time periods having similar conditions in order to determine whether the HVAC system efficiency is degrading and appropriate alarm threshold can be set.

As used in this description, "a" or "an" means "at least one" or "one or more" unless otherwise indicated. In addition, the singular forms "an", and "the" include plural referents unless the content clearly dictates otherwise. As used in this specification, the term "or" is generally employed in its sense including "and/or" unless the content clearly dictates otherwise. The recitation herein of numerical ranges by endpoints includes all numbers subsumed within that range (e.g. 1 to 5 includes 1, 1.5, 2, 2.75, 3, 3.80, 4, and 5).

Unless otherwise indicated, all numbers expressing measurement of properties used in the specification and claims are to be understood as being modified in all instances by the term "about" unless the context clearly dictates otherwise. Accordingly, unless indicated to the contrary, the numerical parameters set forth in the foregoing specification and attached claims are approximations that can vary depending upon the desired properties sought to be obtained by those skilled in the an utilizing the teachings of the present invention. At the very least, each numerical parameter should at least be construed in light of the number of reported significant digits and by applying ordinary rounding techniques. Any numerical value, however, inherently contains certain errors necessarily resulting from the standard deviations found in their respective testing measurements.

Those skilled in the art will recognize that the methods and devices of the present disclosure may be implemented in many manners and as such are not to be limited by the foregoing exemplary embodiments and examples. In other words, functional elements being performed by single or multiple components, in various combinations of hardware and software or firmware, and individual functions, may be distributed among software applications at either the client level or server level or both. In this regard, any number of the features of the different embodiments described herein may be combined into single or multiple embodiments, and alternate embodiments having fewer than, or mores than, all of the features described herein are possible. Functionality may also be, in whole or in part, distributed among multiple components, in manners now known or to become known. Thus, myriad software/hardware/firmware combinations are possible in achieving the functions, features, interfaces and preferences described herein. Moreover, the scope of the present disclosure covers conventionally known manners for carrying out the described features and functions and interfaces, as well as those variations and modifications that may be made to the hardware or software or firmware components described herein as would be understood by those skilled in the art now and hereafter.

Various modifications and alterations to the invention will become apparent to those skilled in the art without departing from the scope and spirit of this invention. It should be understood that the invention is not intended to be unduly limited by the specific embodiments and examples set forth herein, and that such embodiments and examples are presented merely to illustrate the invention, with the scope of the invention intended to be limited only by the claims attached hereto. Thus, while the invention has been particularly shown and described with reference to a preferred embodiment thereof, it will be understood by those skilled in the art that various changes in form and details may be made therein without departing from the spirit and scope of the invention.

What is claimed is:

1. A thermostat for controlling HVAC equipment for a building, the thermostat being mounted within a cabinet enclosing the HVAC equipment, comprising:

one or more current sensing inputs configured to sense currents and electrically connected to current transformers magnetically coupled to one or more phases of an electrical supply powering the HVAC equipment within the cabinet;

one or more voltage sensing inputs configured to sense voltages indicative of the one or more phases of the electrical supply powering the HVAC equipment within the cabinet;

one or more control signal outputs configured to generate HVAC control signals, the HVAC control signals coupled to control inputs of a controller board of the HVAC equipment;

one or more temperature sensing inputs configured to sense a temperature of a zone within the building controlled by the HVAC equipment;

a central processor configured to calculate real time energy use based on the sensed voltages and currents, the processor further configured to control the HVAC equipment to keep the zone within the building within a temperature range based on set points stored within the thermostat and from data from the one or more temperature sensing inputs;

a memory storing:

energy use calculations; and a set of alarm rules that cause the central processor to raise an alarm based on a level of percentage voltage imbalance of the voltages of the phases of the electrical supply powering the HVAC equipment within the cabinet, wherein the central processor is configured to calculate a percentage voltage imbalance of the voltages of the phases of the electrical supply and to apply the set of alarm rules to the calculated percentage voltage imbalance; and a communications port for sending the energy usage calculations to an external device.

2. The thermostat of claim 1, wherein the cabinet enclosing the HVAC equipment has a transformer mounted therein, the transformer having:

a first set of windings coupled to the one or more phases of the electrical supply powering the HVAC equipment, and a second set of windings magnetically coupled to the first set of windings, and electrically coupled to the one or more voltage sensing inputs, wherein the ratio of the first and second transformer windings provide a voltage that is lower than and reflects changes to the one or more phases of the electrical supply powering the HVAC equipment.

3. The thermostat of claim 2, wherein the second set of windings of the transformer supply power to the controller board of the HVAC equipment.

4. The thermostat of claim 1, further comprising:

a first analog-to-digital converter at the voltage sensing inputs that samples and converts the sensed voltage of the HVAC equipment into digital time series voltage data;

a second analog-to-digital converter at the current sensing inputs that samples and converts the sensed current of the HVAC equipment into digital time series current data, wherein the voltage and current sampling occurs simultaneously; and a digital signal processor that receives the digital time series voltage and current data and generates digital time series data representing real power (KW), reactive (KVAR) power, and total power (KVA) data and stores it in the memory.

5. The thermostat of claim 4, wherein the digital signal processor sums the real power (KW), reactive power (KVAR), and total power (KVA) data stored in the memory over a predetermined period of time and stores real power per hour (KWH), reactive power per hour (KVARH), and total power per hour (KVAH) in the memory.

6. The thermostat of claim 4, wherein the set of alarm rules present in the memory causes the central processor to raise an alarm based on the level of percentage current imbalance of the phases of the electrical supply powering the HVAC equipment within the cabinet, and wherein the central processor calculates the percentage current imbalance of the voltages of the phases of the electrical supply and applies the set of alarm rules to the percentage current imbalance.

7. The thermostat of claim 6, wherein the alarm rules cause the central processor to send differing categories of alarm notifications based on the levels of percentage current imbalance, and wherein the central processor operates to shut down the HVAC equipment if the percentage current imbalance exceeds a predetermined threshold.

8. The thermostat of claim 5, wherein one or more of the KWH, KVARH, and KVA calculations are sent over the communication port.

9. The thermostat of claim 5, wherein the power data of the HVAC equipment is the KVA.

10. The thermostat of claim 5, wherein the set of alarm rules causes the central processor to raise an alarm when the KVA exceeds a second predetermined threshold when a compressor of the HVAC equipment is turned off.

11. The thermostat of claim 5, wherein the set of alarm rules causes the central processor to raise an alarm when the KVA falls below a predetermined threshold when a compressor of the HVAC equipment is turned on.

12. The thermostat of claim 5, wherein the set of alarm rules causes the central processor to raise an alarm when the KVA exceeds a predetermined threshold and issue commands to the HVAC controller board to shut down the HVAC equipment.

13. The thermostat of claim 1, wherein the alarm rules cause the central processor to send differing categories of alarm notifications based on the levels of percentage voltage imbalance, and wherein the central processor operates to shut down the HVAC equipment if the percentage voltage imbalance exceeds a predetermined threshold.

14. The thermostat of claim 4, wherein the central processor detects a fan current using the current sensing inputs and compares the fan current to a baseline fan current, wherein a deviation of the fan current from the baseline fan current indicates whether a tension of a fan belt of an HVAC fan belt is excessive.

15. The thermostat of claim 4, wherein the central processor detects a fan current of an HVAC fan using the current sensing inputs and compares the fan current to a baseline fan current, wherein a deviation of the fan current from the baseline fan current indicates whether a tension of fan belt of the HVAC fan is loose.

16. The thermostat of claim 15, further comprising:

a dedicated current transformer magnetically coupled to the power supply of the HVAC fan, the dedicated current transformer being electrically coupled to the current sensing inputs of the thermostat, wherein the digital signal processor calculates and stores in the memory time series data representing a current drawn by the fan.

17. The thermostat of claim 15, wherein the digital signal processor calculates and stores in the memory time series data representing a current drawn by the HVAC equipment, and the central processor designates current data stored while the compressor is turned off as the HVAC fan current.

18. The thermostat of claim 15, wherein the baseline fan current calculated by measurements taken at the time of installation.

19. A thermostat for controlling HVAC equipment for a building, the thermostat being mounted within a cabinet enclosing the HVAC equipment, comprising:

one or more current sensing inputs electrically connected to current transformers magnetically coupled to one or more phases of an electrical supply powering the HVAC equipment within the cabinet;

one or more voltage sensing inputs configured to receive voltages indicative of the one or more phases of the electrical supply powering the HVAC equipment within the cabinet;

one or more control signal outputs configured to generate HVAC control signals, the HVAC control signals coupled to control inputs of a controller board of the HVAC equipment;

one or more temperature sensing inputs configured to sense temperature of a zone within the building controlled by the HVAC equipment;

a central processor configured to:

calculate real time energy use based on the voltage and current measurements, the processor further configured to control the HVAC unit to keep the zone within the building within a temperature range based on set points stored within the thermostat and from data from the one or more temperature sensing inputs; and detect a fan current using the current sensing inputs and compare the detected fan current to a baseline fan current, wherein a deviation of the fan current from the baseline fan current indicates whether a tension of a fan belt is loose or excessive;

a memory for storing energy use calculations; and a communications port for sending energy usage calculations to an external device.

20. A thermostat for controlling HVAC equipment for a building, the thermostat being mounted within a cabinet enclosing the HVAC equipment, comprising:

one or more current sensing inputs electrically connected to current transformers magnetically coupled to one or more phases of an electrical supply powering the HVAC equipment within the cabinet;

one or more voltage sensing inputs configured to receive voltages indicative of the one or more phases of the electrical supply powering the HVAC equipment within the cabinet;

one or more control signal outputs configured to generate HVAC control signals, the HVAC control signals coupled to control inputs of a controller board of the HVAC equipment;

one or more temperature sensing inputs configured to sense temperature of a zone within the building controlled by the HVAC equipment;

a central processor configured to:

calculate real time energy use based on the voltage and current measurements, the processor further configured to control the HVAC unit to keep the zone within the building within a temperature range based on set points stored within the thermostat and from data from the one or more temperature sensing inputs; and detect a fan current of an HVAC fan using the current sensing inputs and compare the detected fan current to a baseline fan current, wherein a deviation of the fan current from the baseline fan current indicates a degree to which a filter associated with the HVAC fan is clogged, and wherein one or more thresholds are set corresponding to one or more degrees to which the filter is clogged;

a memory for storing energy use calculations; and a communications port for sending energy usage calculations to an external device.

* * * * *